US005171116A

United States Patent [19]

Gerhardt et al.

[11] Patent Number: 5,171,116

[45] Date of Patent: Dec. 15, 1992

[54] ATTACHMENT ASSEMBLY FOR SECURING ROOFING MEMBRANES

[75] Inventors: Hans J. Gerhardt; Carl Kramer, both of Aachen, Fed. Rep. of Germany

[73] Assignee: WSP Ingenieurgesellschaft fur Warmetechnik, Stromungstechnik und Prozesstechnik, Fed. Rep. of Germany

[21] Appl. No.: 670,290

[22] Filed: Mar. 15, 1991

[30] Foreign Application Priority Data

Mar. 16, 1990 [DE] Fed. Rep. of Germany ..... 4008517

[51] Int. Cl.[5] ..... F16B 33/00; E04B 5/00

[52] U.S. Cl. ..... 411/368; 411/531; 52/410; 52/512

[58] Field of Search ..... 411/368, 369, 531, 533, 411/545, 915; 52/410, 512; 405/259

[56] References Cited

U.S. PATENT DOCUMENTS

| | | | |
|---|---|---|---|
| 3,415,064 | 12/1968 | Talobre | 405/259 |
| 4,630,984 | 12/1986 | Reinwall et al. | 411/533 |
| 4,718,211 | 1/1988 | Russell et al. | 52/410 |
| 4,726,164 | 2/1988 | Reinwall et al. | 411/533 |
| 4,780,039 | 10/1988 | Hartman | 411/531 |
| 4,787,188 | 11/1988 | Murphy | 52/512 |

FOREIGN PATENT DOCUMENTS

| | | | |
|---|---|---|---|
| 88301965.5 | 3/1988 | European Pat. Off. . | |
| 3420863 | 6/1984 | Fed. Rep. of Germany . | |
| 884660 | 5/1943 | France | 411/531 |

*Primary Examiner*—Neill R. Wilson

*Attorney, Agent, or Firm*—Nikaido, Marmelstein, Murray & Oram

[57] ABSTRACT

The invention is directed to an attachment assembly for securing two membrane strips loosely laid parallel to each other and overlapping with each other. The attachment assembly incorporates a load distribution plate having short and long lateral lever-arm extension means and a bore hole defined in the plate, a fastener screw operatively connected to the load distribution plate through the bore hole, and a fastener screw operatively connected to the load distribution plate through the bore hole. The short and long lateral lever-arm extension means of the plate extend in directions relative to the fastener screw. The short lateral lever arm extension means operates with forces due to the billowing of the roofing membrane so as to uplift a long edge of the load distribution plate and thereby introduce a first force corresponding to a lever arm ratio at the long lateral lever arm extension means at an area opposite to the bore hole. The long lateral lever arm extension means operates with the first force such that the first force generates a pinching action between the roofing membrane and the load distribution plate.

11 Claims, 2 Drawing Sheets

ATTACHMENT ASSEMBLY FOR SECURING ROOFING MEMBRANES

BACKGROUND OF THE INVENTION

The invention is concerned with an attachment assembly to secure two membrane strips loosely laid parallel to each other and overlapping each other, in particular roofing membranes.

Flat roofs or roofs with small inclination angles are very often protected against rain penetration by loose-laid roofing membranes, mechanically secured against wind uplift. A very common and simple method consists of a pointwise attachment using attachment assemblies with, in general, a fastener screw and a load distribution plate in the edge region of the membrane. The next roofing membrane applied to the roof will then overlap the previous membrane and is secured to it by providing a water-proofing of the penetrated previous sheet. The water-proofed attachment of the two membrane strips in the overlap region may be achieved for PVC, EPDM or the like membranes by either hot gas welding or solvent welding. Rectangular, quadratic or circular load distribution plates are common as described in the patent applications EP-OS 0 283 184 and DE-OS 34 20 863.

The fastener screw of those attachments penetrates the load distribution plate in the center and is attached in the substrate on which the roofing membranes shall be attached. Profiled sheet metal is commonly used as a substrate. Symmetrical triangular plates are known for being used in the attachment of such materials as thermal insulation boards.

The sealing membrane in application such as those discussed above will billow under external wind action leading to a wind force on one side of the load distribution plate. This loading will tilt the load distribution plate around the edge of the load distribution plate pointing towards and parallel to the closer membrane edge. The symmetrical arrangement with a central penetration of the load distribution plate by the fastener screw leads to a force which will be approximately twice the applied wind force and which the screw has to transmit to the substrate.

Another disadvantage of the known symmetrical load distribution plates with central placement of the fastener screw is the relatively small pinching force, which the plate edge on the membrane strip.

SUMMARY OF THE INVENTION

The aim of the claimed invention is to design an attachment assembly which avoids those two disadvantages, namely the relatively large force to be taken up by the fastener screw and, at the same time, the relatively small pinching effect between the tilted load distribution plate the sealing membrane.

The advantages obtained with the invention are based on-relative to the tilting axis—the asymmetric form of the load distribution plate in combination with the off-center arrangement of the fastener screw and with a distinct decrease of the width of the load distribution plate which guarantees a favourable pinching between load distribution plate and the overlapped edge of the membrane. Forces, which are excerted by the lifted sealing membrane (e.g. due to wind load) lead to only a small screw force which is transfered to the substrate. At the same time, it is avoided that the sealing membrane will sufficiently not be attached to the thermal insulation layer via the load distribution plate, (i.e., the risk of excessive membrane tear is avoided).

The new attachment assembly may be adapted to different loadings due to the special asymmetry of the load distribution plate relative to the tilting axis.

A general triangular arrangement of the load distribution plate may be easily and economically produced and may be adapted to almost every load situation. A reinforcing fin parallel to the edge of the load distribution plate guarantees sufficient mechanical stiffness and at the same time improves the pinching effect.

Additional changes of the plate embodiment lead to further improvements in the load distribution. Cross section changes in particular in the direction of the bending forces are favourable.

The invention will be described in more detail hereafter with reference to examples of embodiment with the aid of the attached schematic drawings, wherein:

DETAILED DESCRIPTION OF THE PREFERRED EMBODIMENTS

Figure 1:
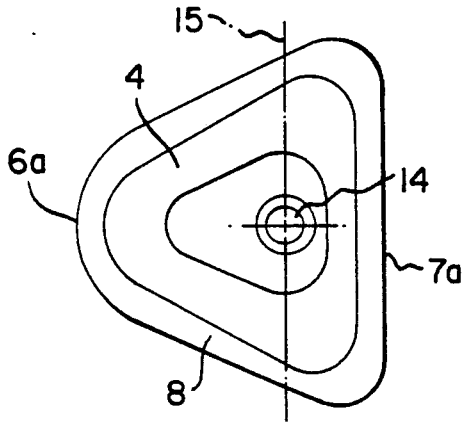
FIG. 1 shows a top view of a prefered embodiment of the load distribution plate.

A load distribution plate (4) of shape as given in FIG. 1 has proven to be successful under tests with simulated windloads on a roof excerpt. This load distribution plate (4) is in general triangular shaped (i.e. its width diminishes from the edge (7*a*) to the opposite edge 6*a*). In the edge region of the load distribution plate (4) a stiffening fin (8) has been realised (The stiffening fin is shown in cross-section in FIG. 3*b*).

The load distribution plate (4) is provided with an off-center hole (14) necessary to pass through a fastener screw (5).

Figure 2:
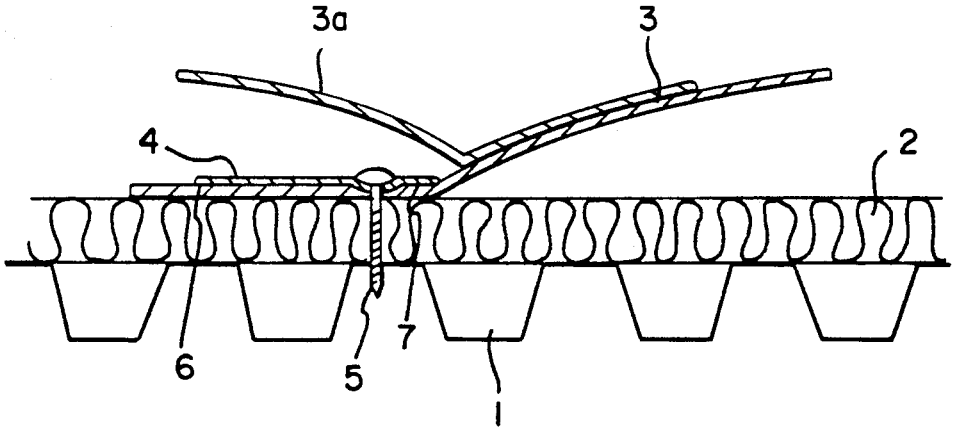
FIG. 2 is a section of a roof showing the attachment assembly fixed to the substrate and the roof membrane billowing under wind action.

FIG. 2 shows a typical roof section with substrate (1), here taken as profiled sheet metal, a thermal insulation layer (2) put on the substrate and a roofing membrane (3) attached to the substrate (1) and the thermal insulation layer (2) by means of the attachment assembly consisting of the load distribution plate (4) and the fastener screw (5). The attachment assembly (4), (5) is situated in the edge region of membrane (3). A second roof membrane (3*a*) extending from the left in FIG. 2 overlaps the attachment assembly (4), (5) and is joined with its edge region at the right of the attachment assembly (4), (5) with the upper surface of the membrane (3), (e.g. hot gas welded or solvent welded).

Under wind action, in particular higher wind speeds, the two membranes (3), (3*a*) billow as indicated in FIG. 2. Therefore a force is exerted at that part of the load distribution plate (4), which is parallel to the membranes (3), (3*a*). This leads to a tilting moment around the tilting axis (15) running through hole (14), see FIG. 1.

Therefore, the load distribution plate (4) shown in FIG. 1 is set between the lower membrane (3) and the upper membrane (3*a*) in such a way that its edge (7*a*) is parallel to the edges of the two said membrane strips (3), (3*a*). The hole (14) and thus the fastener screw (5) are in an off-center position in the load distribution plate (4), namely closer to the edge (7*a*) which is pointing to the attachment area between membranes (3), (3*a*).

The distance between hole (14) and fastener screw (5) respectively and the pointed edge (6*a*) is much larger, thus obtaining a more favourable pinching between the load distribution plate and the edge region of the membrane (3*a*). This clamping action will be improved if, as shown in FIG. 2, the membranes (3), (3*a*) are billowing due to the wind action and thus tilting the load distribution plate (4) around its tilting axis (15), see FIG. 1. The tilting axis is perpendicular to the attachment screw (5) and parallel to the edges of the membranes (3), (3*a*).

Thus, the force due to a possible tilting of the load distribution plate (4), which has to be taken up by the fastener screw (5), is only marginally larger than the wind force due to the billowing membranes (3), (3*a*) which is on the load distribution plate (4) along the edge (7*a*) of the load distribution plate (4). At the same time, the large distance between hole (14) and fastener screw (5), respectively and the pointed part (6*a*) of the triangular shaped load distribution plate (4) assures a large lever-arm-ratio and thus a large pinching action in the region between hole (14) and pointed area (6*a*) of the load distribution plate (4) towards the overlapped membrane (3) if the load distribution plate (4) is tilted around its tilting axis (15).

The favourable clamping action is obtained due to the fact that the load distribution plate (4) is asymmetric to the axis perpendicular to the membrane direction and to the tilting axis (15). The width of the load distribution plate (4) measured in the membrane strip direction decreases from the edge (7*a*) closer to the fastener screw (5) to the edge (6*a*), leading to the desired good pinching action in combination with the described lever-arm action.

Figure 3A:
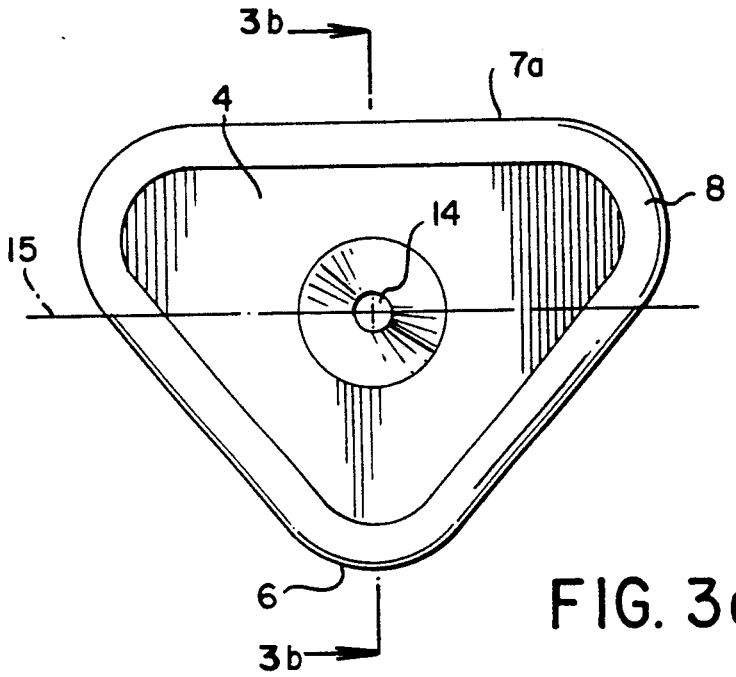
FIG. 3*a* is a top view of the load distribution plate incorporating further formings therein.
Figure 3B:
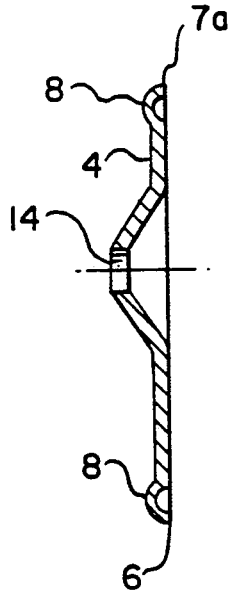
FIG. 3*b* shows a cross-sectional view of FIG. 3*a*.

As shown in FIGS. 3*a* and 3*b*the load distribution plate (4) may be provided with further formings in addition to the stiffening fin (8) which will lead to a better load distribution. Those additional formings should extend in the direction of the bending loads.

We claim:

1. An attachment assembly to secure loose-laid roofing membranes, placed parallel to each other and overlapping each other in a narrow strip comprising:

a load distribution plate having defined therein a bore hole, and short and long lateral lever-arm extension means each defined to extend toward outer peripheral edges of said load distribution plate relative to the bore hole and away from each other; and a fastener screw operatively connected to said load distribution plate through the bore hole, the short and long lateral lever-arm extension means of said plate extending toward the outer peripheral edges relative to said fastener screw in the bore hole, the short lateral lever-arm extension means for generating a first force corresponding to a lever-arm ratio at the long lateral lever-arm extension means, and counteracting forces due to billowing of the roofing membrane, the long lateral lever-arm extension means being located at an area opposite the short lateral lever-arm extension means relative to the bore hole of said load distribution plate, and the long lateral lever-arm extension means for operating with the first force such that the first force generates a pinching action between the roofing membrane and said load distribution plate, the short and long lateral lever-arm extension means of said load distribution plate relative to an axis of said fastener screw being formed larger in a direction to an edge of the membrane to be attached than in a direction towards a center of the membrane.

2. An attachment assembly according to claim 1, wherein a width of said load distribution plate decreases from a relative central area of said load distribution plate to outer peripheral edges of said load distribution plate along axes of the short and long lateral lever-arm extension means.

3. An attachment assembly according to claim 1, wherein said load distribution plate is provided with at least 1 stiffening fin along edges of said load distribution plate.

4. An attachement assembly according to claim 1, wherein an area of said load distribution plate is unsymmetrical relative to the bore hole of said load distribution plate wherein the bore hole is defined to be offset from a center of said plate.

5. An attachement assembly according to claim 4, wherein a width of said load distribution plate decreases from a relative center of said load distribution plate to edges of said load distribution plate along axes of the short and long lateral lever-arm extension means.

6. An attachment assembly according to claim 2, wherein said load distribution plate is provided with at least 1 stiffening fin along edges of said load distribution plate.

7. An attachment assembly according to claim 2, wherein the short and long lateral lever-arm extension means of said load distribution plate relative to an axis of said fastener screw are formed larger in a direction to an edge of the membrane to be attached than in a direction towards a center of the membrane.

8. An attachment assembly according to claim 7, wherein said load distribution plate is provided with at least 1 stiffening fin along edges of said load distribution plate.

9. An attachment assembly according to claim 1, wherein said load distribution plate has a substantially triangular shape.

10. An attachment assembly according to claim 9, wherein a width of said load distribution plate decreases from a relative center of said load distribution plate to edges of said load distribution plate along axes of the short and long lateral lever-arm extension means.

11. An attachment assembly according to claim 9, wherein said load distribution plate is provided with at least 1 stiffening fin along edges of said load distribution plate.

* * * * *